US005309793A

United States Patent [19]

Tipp

[11] Patent Number: 5,309,793

[45] Date of Patent: May 10, 1994

[54] COMPACT TOOL FOR OPENING BOTTLE CAPS

[76] Inventor: Raymond P. Tipp, P.O. Box 3778, Missoula, Mont. 59806

[21] Appl. No.: 28,700

[22] Filed: Mar. 8, 1993

Related U.S. Application Data

[63] Continuation-in-part of Ser. No. 946,888, Sep. 18, 1992.

[51] Int. Cl.[5] ..... B25B 13/52

[52] U.S. Cl. ..... 81/3.43; 81/64

[58] Field of Search ..... 81/3.43, 3.4, 64

[56] References Cited

U.S. PATENT DOCUMENTS 2,023,975 12/1935 Qualey ..... 81/64
2,554,410 5/1951 Horton ..... 81/3.4
4,010,662 3/1977 Perrault ..... 81/64
4,058,031 11/1977 Magarian ..... 81/64

*Primary Examiner*—Robert C. Watson
*Attorney, Agent, or Firm*—Harry M. Cross, Jr.

[57] ABSTRACT

This invention relates to devices for unscrewing bottle caps. More particularly, this invention relates to flexible bottle cap openers designed to be conformed to the circumference of bottle caps and engaged by a person's thumb and fore finger to twist open a bottle cap. This invention comprises a flexible strip of elastomeric material having a thin, flat, narrow, elongated body formed with transverse alternating ribs and grooves located only at the ends on one side of the body and located only at the elongated mid-portion on the other side of the body.

11 Claims, 1 Drawing Sheet

COMPACT TOOL FOR OPENING BOTTLE CAPS

RELATED APPLICATION

This application is a continuation-in-part of application Ser. No. 07/946,888 filed Sep. 18, 1992 now abandoned.

FIELD OF THE INVENTION

This invention relates to devices for unscrewing bottle caps. More particularly, this invention relates to flexible bottle cap openers designed to be conformed to the circumference of bottle caps and engaged by a person's thumb and fore finger to twist open a bottle cap.

BACKGROUND OF THE INVENTION

Removal of twist-off bottle caps is difficult without some device to protect hand flesh from the sharp formed ribs and grooves of the cap, or to prevent slippage. There are unitary bottle cap removers of various forms which have been found to be bulky, inconvenient and cumbersome for regular and constant carriage upon the person or in the user's pockets or to be attachable to bottle packages.

SUMMARY OF THE INVENTION

This invention comprises a flexible strip of elastomeric material having a thin, flat, narrow, elongated body formed with transverse ribs and grooves. One side of the body is formed with transverse alternating ribs and grooves substantially completely along the longitudinal length thereof except for its end portions; each end portion having a raised flat surface at the elevation of the ribs. The other side of the body is formed with transverse alternating ribs and grooves only along each end portion; the substantially greater longitudinal mid-portion having a depressed flat surface below the elevation of the ribs. One end portion is provided with a hole, extending through the body, perpendicular to the sides of the body, for a small detachable chain or cord by which the tool may be attached to a bottle package.

The body of the tool of this invention presents a bottle cap engagement face with ribs and grooves adapted to engage a smooth bottle cap, or a bottle cap of the type having circumferential ribs and grooves, when the back is articulated by finger and thumb pressure from its straight flat plane to circumferentially enclose the bottle cap for positive and effective engagement; the opposite face comprising ribs and grooves to be engaged by finger and thumb to provide a non-slip surface when finger and thumb pressure is applied to articulate the body. The body is two-sided so that the user has the option of applying either a predominantly multiple-grooved face to the bottle cap or a predominantly smooth surface to the bottle cap.

DETAILED DESCRIPTION OF THE INVENTION

Figure 1:
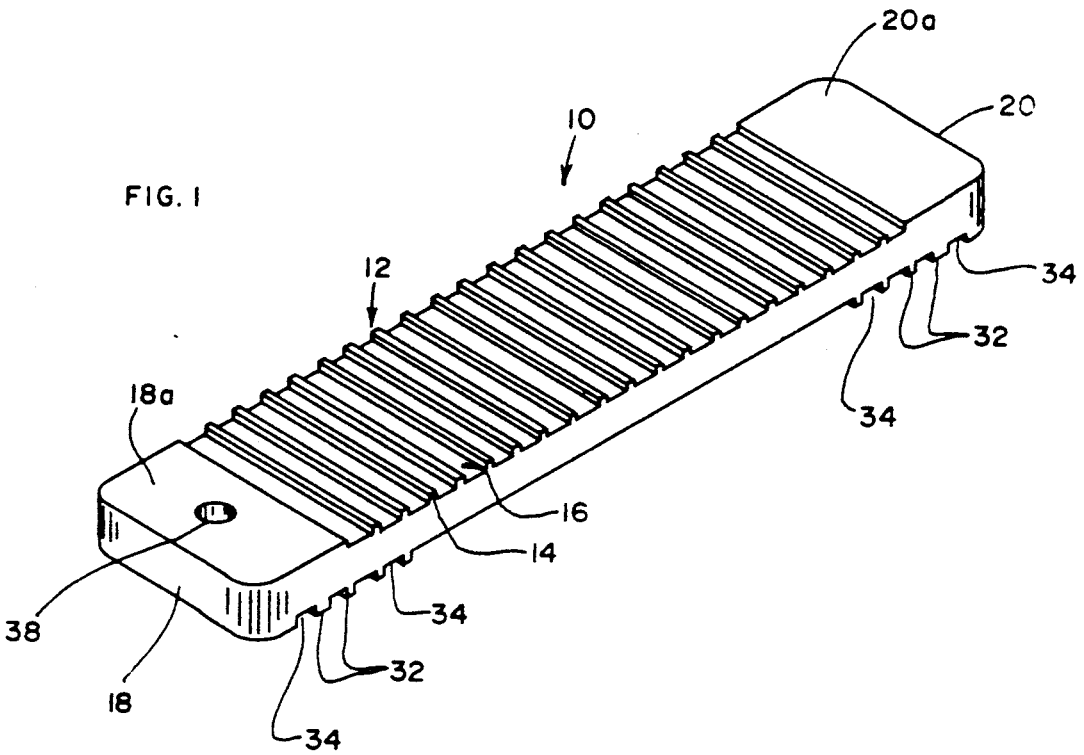
FIG. 1 is a perspective view of the tool of this invention.
Figure 2:
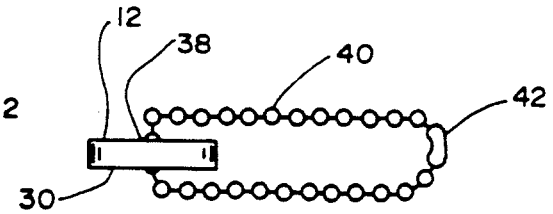
FIG. 2 is an end view of the FIG. 1 tool, illustrating the detachable chain.
Figure 3:
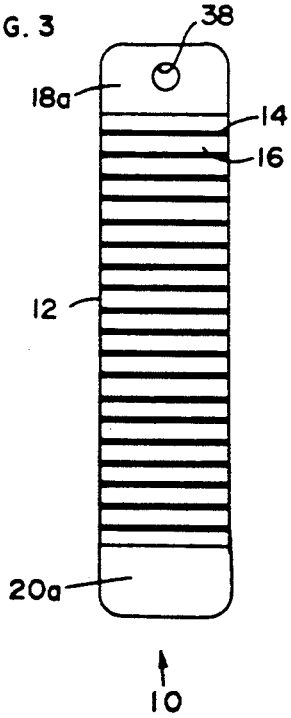
FIG. 3 is plan view of one side of the FIG. 1 tool.
Figure 4:
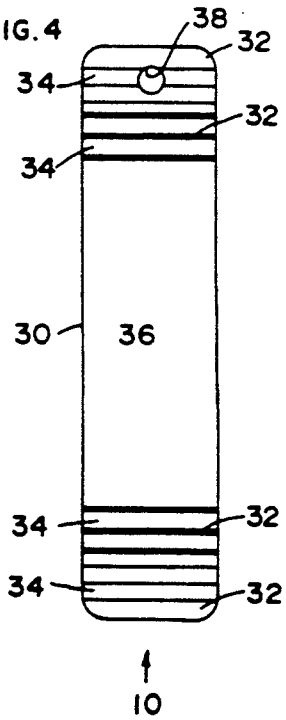
FIG. 4 is a plan view of the other side of the FIG. 1 tool.
Figure 5:
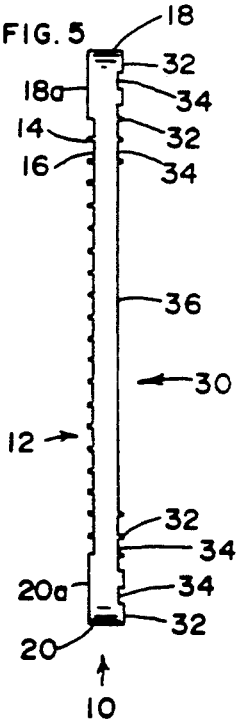
FIG. 5 is a side edge view of the FIG. 1 tool.

This invention comprises a flexible strip of elastomeric material having a thin, flat, narrow, elongated body 10 formed with transverse ribs and grooves. One side 12 of the body 10 is formed with transverse alternating ribs 14 and grooves 16 substantially completely along the longitudinal length thereof except for its end portions 18, 20; each end portion, 18 or 20, having a raised flat surface 18*a*, 20*a* at the elevation of the ribs as seen in FIG. 5. The other side 30 of the body 10 is formed with transverse alternating ribs 32 and grooves 34 only along each end portion 18, 20; the substantially greater longitudinal mid-portion 36 having a depressed flat surface below the elevation of the ribs, also as shown in FIG. 5. One end portion is provided with a hole 38, extending through the body, perpendicular to the sides of the body, for a small detachable chain or cord 40 by which the tool may be attached to a bottle package. A preferred tool has a body length of about 3 inches, a body width of about ½ inch, and a body thickness of about ⅛ inch. The ribs 14 and grooves 16 on body side 12 are preferably equi-spaced and trapezoidal in cross section with the ribs 12 having a narrower outer edge and a wider base. The ribs 32 and grooves 34 on the opposite body side 30 are preferably rectangular in cross section. The raised flat surfaces 18*a*, 20*a* may be textured to provide an enhanced gripping surface.

The body 10 is fabricated preferably of a thermoplastic elastomer such as SANTOPRENE rubber. SANTOPRENE rubber is an olefinic thermoplastic vulcanizate. Any suitable elastomer may be employed so long as the properties of the body 10 enable it to flex to the degree required to circumvent a bottle cap. The body 10 is flexible enough that it can longitudinally wrap around small bottle caps such as are found on beverage bottles. The body 10 is also flexible enough that it can be flexed transversely to its longitudinal length where necessary to conform to the varying contour of a bottle cap edge in order to provide an adequate grip when engaging a bottle cap. In a typical bottle-opening procedure, the body 10 would be wrapped around a bottle cap, a person's thumb would be placed against one end portion of the body and the side of the person's doubled-up forefinger would be placed against the other end portion of the body, and the bottle cap would be twisted off. For some bottle cap configurations, it may be preferable to apply the tool with the body side 12 against the cap so that body side 30 is exposed for gripping. For other bottle cap configurations, it may be preferable to apply the tool with the body side 30 against the cap so that body side 12 is exposed for twisting. Different people may find one body side or the other more to their liking for twisting. Thus, some people may prefer to have the multiplicity of ribs 14 and grooves 16 on body side 12 exposed and other people may prefer to have the flat mid-portion 30 on body side 30 exposed.

The chain 40 is looped through the hole 38 and is provided with a clasp 42. The chain may be opened and secured to a beverage bottle carton, inserted through a belt loop; it may be looped around a peg; or it may be attached to a key: all by way of example. Alternately, a key ring could be substituted for the chain 40. The physical dimensions of the body 10 are small enough that the tool may be easily carried in a person's pocket. A small magnet 50 could be applied to the body face 20*a* as shown so that the tool could be "stuck" to a refrigerator or some other metallic object for convenient access.

Thus, it will be seen that there is provided a simple, compact, efficient, non-bulky, and practical bottle cap remover which achieves the various objects of the invention, and which is well adapted to meet the conditions of practical use. It achieves the purposes and meets the conditions of a bottle cap remover so as to encourage users to carry the tool with them and thereby facilitate the general availability to the tool whenever needed, and make available to the user a means to remove twist-off bottle caps without injury to themselves.

While the preferred embodiment of the invention has been described herein, variations in the design may be made. The scope of the invention, therefore, is only to be limited by the claims appended hereto.

The embodiments of the invention in which an exclusive property is claimed are defined as follows:

1. A pocket tool for opening bottle caps comprising a flexible, elongated, narrow and flat body having two end portions and an elongated mid-portion extending between the end portions, said body having a length and width small enough for said tool to fit into a user'pants pocket; said body having a first side containing a plurality of transverse alternating ribs and grooves located only on said elongated mid-portion and extending substantially completely along the length of said elongated mid-portion between the two end portions; said body having a second side containing transverse alternating ribs and grooves located only along each end portion and an elongated flat surface extending between the ribs and grooves thereof substantially completely along the length of said elongated mid-portion; said end portions providing parallel finger-contacting surface means shaped to be contacted by the user's thumb and finger and pressed against a bottle cap whereby said tool may be engaged with the bottle cap and the bottle cap twisted open as a result of thumb and finger pressure on said surface means causing said tool to be pressed against the bottle cap; the first and second sides of said body being so constructed and arranged with respect to one another whereby said tool is reversible and either side may be employed to contact a bottle cap to be removed with the other side being presented for engagement by a user's thumb and finger.

2. The tool of claim 1 wherein one end portion is provided with a hole, extending through the body, perpendicular to the sides of the body; and including a small detachable chain extending through the hole by which the tool may be secured to another object for storage or the like.

3. The tool of claim 1 wherein said first side ribs and grooves extend substantially completely along the longitudinal length of said body except for the end portions thereof, and wherein a flat surface is located at each end portion, said flat surfaces providing thumb and finger contacting means.

4. The tool of claim 3 wherein said first side flat surfaces are elevated to the plane of the first side ribs; and wherein the second side elongated flat surface is depressed from the second side ribs.

5. The tool of claim 3 wherein one end portion is provided with a hole, extending through the body, perpendicular to the sides of the body; and including a small detachable chain extending through the hole by which the tool may be secured to another object for storage or the like.

6. The tool of claim 3 wherein the first side ribs and grooves are trapezoidal in cross section.

7. A pocket tool for opening bottle caps comprising a flexible, elongated, narrow and flat body having two end portions and an elongated mid-portion extending between the end portions, said body having a length and width small enough for said tool to fit into a user's pants pocket; said body having a first side containing a plurality of transverse alternating ribs and grooves located only on said elongated mid-portion and extending substantially completely along the length of said elongated mid-portion between the two end portions; said body having a second side containing transverse alternating ribs and grooves located only along each end portion and an elongated flat surface extending between the ribs and grooves thereof substantially completely along the length of said elongated mid-portion; said end portions providing parallel finger-contacting surface means shaped to be contacted by a user's thumb and finger and pressed against a bottle cap whereby said tool may be engaged with the bottle cap and the bottle cap twisted open as a result of thumb and finger pressure on said surface means causing said tool to be pressed against the bottle cap; the flat surface means of the first side of said body being elevated to the plane of the first side ribs, and the second side elongated flat surface being depressed from the second side ribs; the first and second sides of said body being so constructed and arranged with respect to one another whereby said tool is reversible and either side may be employed to contact a bottle cap to be removed with the other side being presented for engagement by a user's thumb and finger; one end portion of said body being provided with a hole, extending through the body, perpendicular to the sides of the body; and including a small detachable chain extending through the hole by which the tool may be secured to another object for storage or the like.

8. The tool of claim 7 wherein said tool has a body length of about 3 inches, a body width of about ½ inch, and a body thickness of about ⅛ inch, the length of said end portions being substantially less than the length of said elongated mid-portion.

9. The tool of claim 1 wherein said tool has a body length of about 3 inches, a body width of about ½ inch, and a body thickness of about ⅛ inch, the length of said end portions being substantially less than the length of said elongated mid-portion.

10. The tool of claim 1 wherein a flat magnet is affixed to one of the rib-free end portion surface means whereby said tool may be releaseably-attached to a metal surface.

11. The tool of claim 7 wherein a flat magnet is affixed to one of the rib-free end portion surface means whereby said tool may be releaseably-attached to a metal surface.

* * * * *